US005328207A

United States Patent [19]

Hannah

[11] Patent Number: 5,328,207

[45] Date of Patent: Jul. 12, 1994

[54] AUTOGRAPHED PHOTOGRAPH AND METHOD

[76] Inventor: William M. Hannah, 2720 N. 68th St., Suite 5-499, Scottsdale, Ariz. 85257

[21] Appl. No.: 797,362

[22] Filed: Nov. 25, 1991

[51] Int. Cl.[5] ..... B42D 15/00

[52] U.S. Cl. ..... 283/77; 283/70

[58] Field of Search ..... 283/62, 77, 904, 75, 283/86, 101, 109, 67, 70

[56] References Cited

U.S. PATENT DOCUMENTS 3,758,970 9/1973 Annenberg ..... 283/77 X
3,949,501 4/1976 Andrews et al. ..... 283/82
4,070,774 1/1978 Staats et al. ..... 283/77 X
4,171,864 10/1979 Jung et al. ..... 283/904

*Primary Examiner*—Timothy V. Eley
*Assistant Examiner*—Willmon Fridie, Jr.
*Attorney, Agent, or Firm*—Harry M. Weiss

[57] ABSTRACT

An autographed photograph of a baseball player or other person and method of making the autographed photograph. The autographed photograph has a standard photograph and has a signature sheet affixed to the standard photograph. The signature sheet is at least one of a plurality of separable clear flexible plastic material sheets having an adhesive layer on a back surface thereof to attach to any memento.

4 Claims, 1 Drawing Sheet

AUTOGRAPHED PHOTOGRAPH AND METHOD

The invention relates to an autographed photograph and method, and in particular the invention relates to an autographed photograph having an original signature sheet attached thereto.

BACKGROUND OF THE INVENTION

The prior art autographed photograph includes a photograph having a front surface on which an original signature is signed.

One problem with the prior art autographed photograph is that it is difficult to have the photograph taken and the respective signature done in one meeting.

SUMMARY OF THE INVENTION

Brief Description of Preferred Embodiment

According to the present invention, an autographed photograph is provided. The autograph photograph comprises a photograph and a signature which is attached thereto.

By using the signature sheet, the problem of one being able to take the photograph and do the signature in one meeting is avoided.

Also according to the invention, a method of making an autographed photograph is provided. This method includes:

making a photograph, signing by a person related thereto of an original signature on a sheet of clear flexible material; and attaching the signature to the photograph using clear adhesive material, after developing the photograph.

An object of the invention is to provide a method of making an autographed photograph in one meeting.

Another object of the invention is to minimize the difficulty of placing an original signature on shaped mementos, such as a baseball or a baseball bat, or the like.

The foregoing and other objects, features and advantages will be apparent from the following description of the preferred embodiment of the invention as illustrated in the accompanying drawings.

DESCRIPTION OF THE PREFERRED EMBODIMENT

Figure 1:
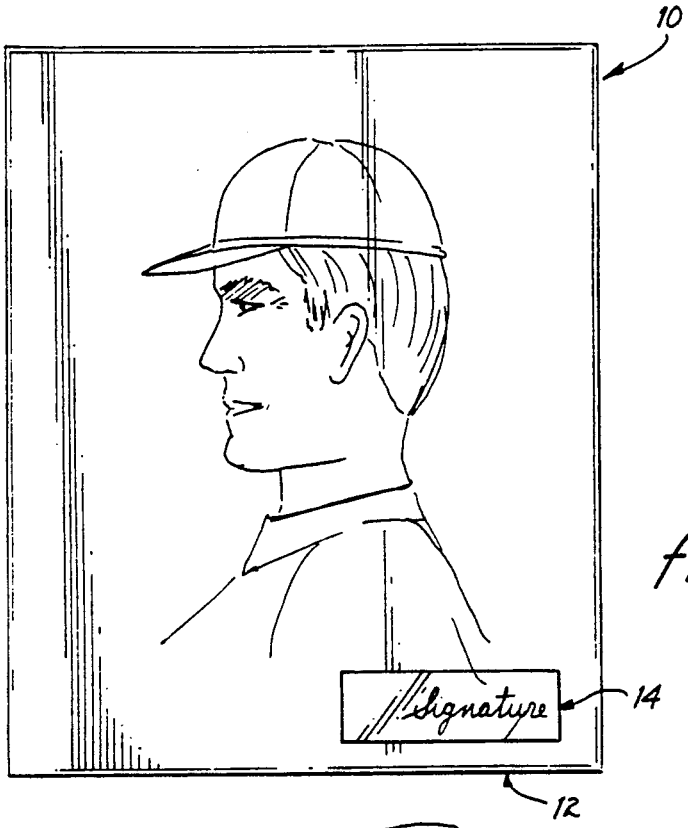
FIG. 1 is a plan view of an autographed photograph according to the present invention.

As shown in FIG. 1, an autographed memento or photograph 10, which shows a celebrity, such as a baseball player, or the like, is provided. This photograph 10 has a base photo sheet 12, and has a signature sheet 14, which is attached thereto.

Base 12 is a standard photograph. In one model of this embodiment 10, it is about 8 inches wide by 12 inches high by 0.016 inches thick.

Figure 2:
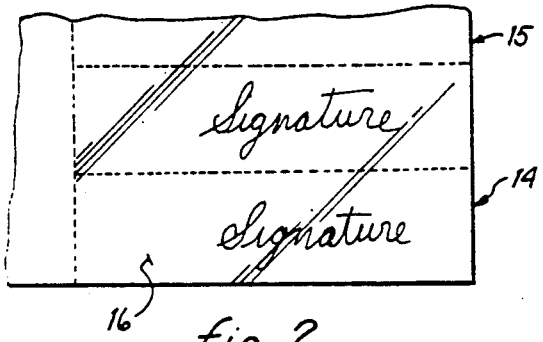
FIGS. 2 through 5 show plan views of different layers of the signature sheet which is a portion of FIG. 1.
Figure 3:
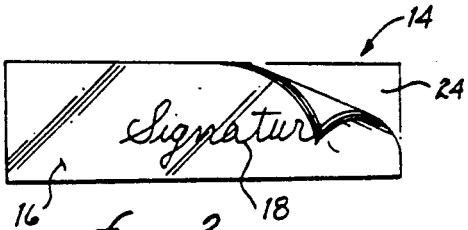
Figure 4:
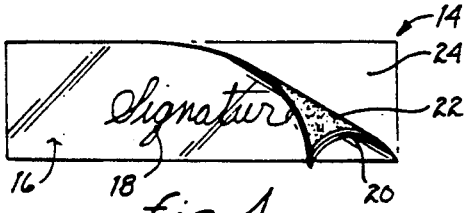

As shown in FIG. 2, 3, and 4, the signature sheet 14 is separated from a multi-sheet perforated sheet 15. Sheet 14 has a front surface 16 on which an original signature 18 is signed. Sheet 14 has a rear surface 20. Sheet 14 is typical of all other sheets in assembly 15.

Figure 5:
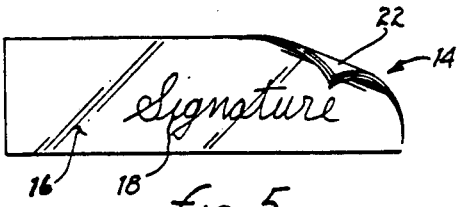

As shown in FIG. 5, rear surface 20 has an adhesive layer 22. Layer 22 is made of a clear acrylic glue. Sheet 14 is made of a clear polyester plastic material. Layer 22 has a backup paper 24, which is attached thereto, and which is peeled off before sticking sheet 14 on photograph 12.

Original signature 18 is made using an extra fine permanent marker, in blue color, such as the marker or pen made by Sanford Company. Original signature 18 is placed on front surface 16.

The process of making photograph 10 includes the steps of, making a photograph 12 of a person; affixing by the person of his original signature 18 to front face 16 of each sheet 14 of clear perforated multi-sheet assembly 15; separating the signature sheet 14 from the perforated assembly 15; removing the backup paper 24; and adhering the adhesive layer 22 of the sheet 14 to the photograph 12.

Figure 6:
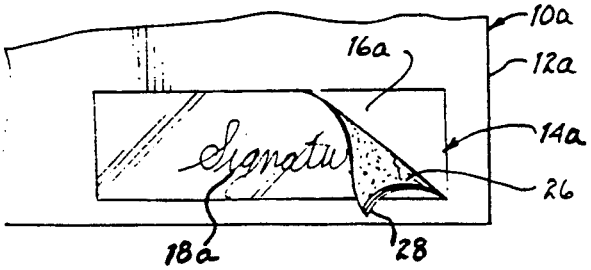
FIG. 6 shows a plan view of an alternate embodiment of the autographed photograph of FIG. 1.

As shown in FIG. 6, an alternative embodiment 10*a* is provided. Parts of embodiment 10*a*, which are the same as corresponding parts of embodiment 10, have the same numerals, but with a subscript "a" added thereto. Embodiment 10*a* has a sheet 14*a*, which has a front surface 16*a*, that has a clear acrylic adhesive 26, like adhesive 22. Sheet 14*a* also has a front sheet 28, made of a clear acrylic plastic material. After signature 18*a* is placed on surface 16*a*, sheet 28 is placed over sheet 14*a*. Later, backup paper (not shown) is removed to attach sheet 14*a* to the photograph 12*a* of embodiment 10*a*.

While the invention has been described in its preferred embodiment, it is to be understood that the words which have been used are words of description rather than limitation and that changes may be made within the purview of the appended claims without departing from the true scope and spirit of the invention in its broader aspects. For example, instead of photograph 12 showing a baseball celebrity, a friend, or the like, can be shown.

As another example, instead of photograph 12, a baseball or a baseball bat, or a basketball, can be used. The flexible material of sheet 14 permits adherence of sheet 14 to a baseball spherical surface or a bat cylindrical surface, or the like.

I claim:

1. An autographed memento comprising:

a base member having an outer surface;

a separate signature sheet attached to the base members outer surface;

said signature sheet having a front surface and a rear surface;

said front surface having an original signature of a person related to said base member; and said rear surface having an adhesive layer which joins said sheet to said base member wherein the memento is an autographed photograph; the person is a celebrity; and the base member is a photograph of the celebrity.

2. The memento of claim 1, wherein the signature sheet is a portion of a transparent multi-sheet perforated assembly, and is separate therefrom.

3. A method of making an autographed memento, including the steps of:

forming a memento related to a person;

affixing by the person of their original signature to a front face of a separate signature sheet made of clear, flexible plastic material;

forming an adhesive on a rear surface of the signature sheet; and joining the adhesive to the memento on its front surface.

4. The method of claim 4, including the steps of:

separating the signature sheet from a multi-sheet assembly before joining the adhesive to the memento; and removing a backup paper disposed over the adhesive before joining the adhesive to the memento.

* * * * *